US011169475B2

(12) United States Patent
Kawabata et al.

(10) Patent No.: US 11,169,475 B2
(45) Date of Patent: Nov. 9, 2021

(54) POWER SUPPLY APPARATUS AND IMAGE FORMING APPARATUS

(71) Applicant: Konica Minolta, Inc., Tokyo (JP)

(72) Inventors: Shinichi Kawabata, Hino (JP); Kanehiro Watanabe, Sagamihara (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/913,213

(22) Filed: Jun. 26, 2020

(65) Prior Publication Data

US 2020/0409295 A1 Dec. 31, 2020

(30) Foreign Application Priority Data

Jun. 26, 2019 (JP) ..... JP2019-117975

(51) Int. Cl.
*G03G 15/00* (2006.01)
*G03G 21/20* (2006.01)
*G03G 15/20* (2006.01)

(52) U.S. Cl.
CPC ..... *G03G 15/5004* (2013.01); *G03G 15/2017* (2013.01); *G03G 21/206* (2013.01)

(58) Field of Classification Search
None
See application file for complete search history.

(56) References Cited

U.S. PATENT DOCUMENTS 4,851,965 A * 7/1989 Gabuzda ..... H05K 7/20154 361/691
2008/0252949 A1* 10/2008 Choi ..... H04N 1/00904 358/505
2010/0124018 A1* 5/2010 Yoshida ..... G03G 21/206 361/695
2010/0215393 A1* 8/2010 Sasaki ..... G03G 15/5004 399/88
2011/0110679 A1* 5/2011 Nishikawa ..... G03G 21/206 399/92

FOREIGN PATENT DOCUMENTS

JP 2007240657 A 9/2007

* cited by examiner

*Primary Examiner* — Victor Verbitsky
(74) *Attorney, Agent, or Firm* — Cantor Colburn LLP

(57) ABSTRACT

A power supply apparatus includes a plurality of power supply boards and a cooler. The power supply boards supply power. The cooler cools the power supply boards. The power supply boards are disposed in rows in a front-back direction and stepwise so as to be disposed more upward as disposed more forward.

17 Claims, 8 Drawing Sheets

POWER SUPPLY APPARATUS AND IMAGE FORMING APPARATUS

CROSS-REFERENCE TO RELATED APPLICATIONS

The present invention claims priority under 35 U.S.C. § 119 to Japanese Patent Application No. 2019-117975 filed Jun. 26, 2019, the entire content of which is incorporated herein by reference.

BACKGROUND

Technological Field

The present disclosure relates to a power supply apparatus and an image forming apparatus.

Description of the Related Art

Conventionally, there has been known an electrophotographic image forming apparatus that forms an image on a sheet of paper by developing an electrostatic latent image formed on a photoreceptor with toner, thereby forming a toner image, transferring the formed toner image onto a sheet of paper, and heating and fixing the transferred toner image to the sheet.

The abovementioned image forming apparatus includes a power supply apparatus that transforms power into low-voltage power for driving mechanical components relevant to image forming.

Such a power supply apparatus generates heat by operating, and when overheating, declines in function and becomes unstable, and also causes problems in peripherals. Hence, power supply apparatuses are required to have arrangement of components and a cooling structure that can efficiently release heat.

In order to efficiently cool power supply apparatuses, there is disclosed, for example, in JP 2007-240657 A, a configuration in which power supply boards (power supply units) are each placed so as to be horizontally long, are housed on three shelves arranged vertically, and are provided with air-blowing fans.

SUMMARY

In recent years, PPM (Page Per Minute) of machines has been on a rising trend due to requests from the market, and the number of types of electrical components of machines has been increasing, and also power supply capacity has been increasing. In addition, internal temperature of machines has been on a rising trend with increase in PPM because the size of machines cannot be increased much due to requests for downsizing. In such a situation, conventional configurations for air exhausting and heat insulation cause power supply boards to have a temperature exceeding the upper limit of target temperature, and consequently cause malfunctions of machines and damage to the power supply boards. To solve these problems, a method of increasing the number of power supply boards may be used. However, in the case of the configuration disclosed in JP 2007-240657 A, increasing the number of power supply boards decreases cooling efficiency, and accordingly decreases cooling performance of power supply boards. Further, as the number of power supply boards is increased, the number of air-blowing fans is increased, which increases noise level and costs.

Objects of the present disclosure include providing a power supply apparatus and an image forming apparatus that can prevent increase in internal temperature, thereby preventing malfunctions and damage to power supply boards.

According to an aspect of the present disclosure, there is provided a power supply apparatus including:

a plurality of power supply boards that supplies power; and a cooler that cools the power supply boards, wherein the power supply boards are disposed in rows in a front-back direction and stepwise so as to be disposed more upward as disposed more forward.

According to another aspect of the present disclosure, there is provided an image forming apparatus including:

an image former that forms an image on paper; and the above power supply apparatus, wherein the power supply apparatus supplies power to the image former.

BRIEF DESCRIPTION OF THE DRAWINGS

The objects, advantages, and characteristics provided by one or more embodiments of the present invention will become more fully understood from the detailed description given hereinbelow and the appended drawings that are given by way of illustration only, and thus are not intended as a definition of the limits of the present invention, wherein.

DETAILED DESCRIPTION OF EMBODIMENTS

Hereinafter, one or more embodiments of the present invention are described in detail with reference to the drawings. However, the scope of the present invention is not limited to the embodiments or illustrated examples.

Figure 1:
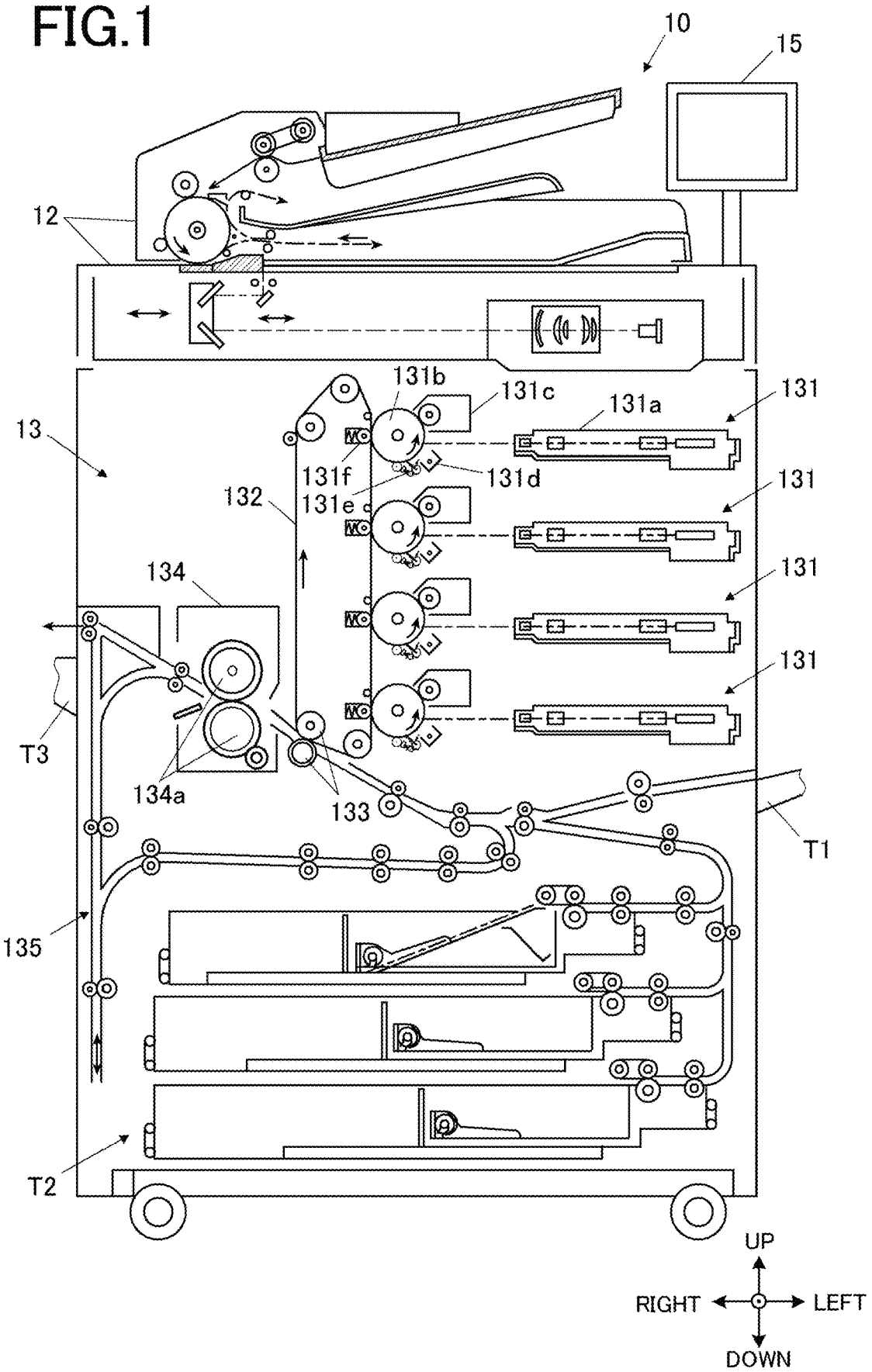
FIG. 1 is a front view schematically showing configuration of an image forming apparatus according to an embodiment(s)
Figure 2:
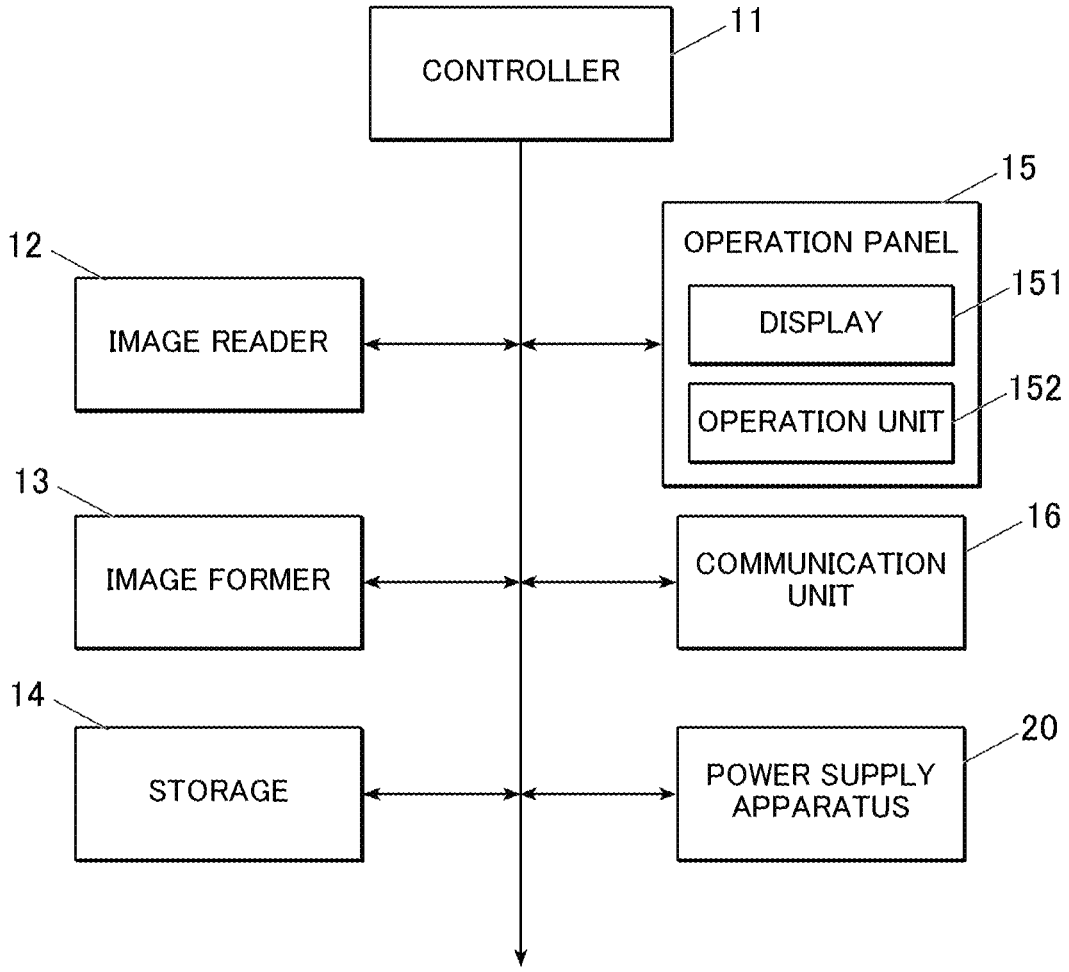
FIG. 2 is a block diagram showing functional configuration (control structure) of the image forming apparatus.

An image forming apparatus 10 according to an embodiment(s) includes, as shown in FIG. 1 and FIG. 2, a controller 11 (hardware processor), an image reader 12, an image former 13, a storage 14, an operation panel 15 (a display 151 and an operation unit 152), a communication unit 16 and a power supply apparatus 20.

In the following description, an operational surface side of the image forming apparatus 10 is referred to as front (front side), and a plane on the deep side facing the front is referred to as back (back side). The depth direction from/to the front to/from the back is referred to as front-back direction, the horizontal direction orthogonal to the front-back direction is referred to as left-right direction, and a direction orthogonal to the front-back direction and the left-right direction is referred to as up-down direction.

The controller 11 includes a CPU, a RAM and a ROM. In accordance with operation signals input from the operation unit 152 or instruction signals received by the communication unit 16, the CPU reads various process programs stored in the ROM, loads the read programs into the RAM, and collectively controls operation of the image forming apparatus 10 in cooperation with the programs loaded into the RAM.

The image reader 12 scans and exposes images of documents placed on a platen or an auto document feeder (ADF) (both not shown) with an optical system of a scanning exposure device, and reads the reflected light with a line image sensor, thereby obtaining image signals. The image signals are subjected to processing, such as analog-to-digital (A/D) conversion, shading correction and/or compression, and then input to the controller 11 as image data. The image data to be input to the controller 11 is not limited to the image data read by the image reader 12, and may be image data received from external apparatuses (not shown) connected via the communication unit 16, for example.

The image former 13 forms images composed of four colors of C, M, Y and K on sheets of paper on the basis of pixel values of the four colors of each pixel of processed original images.

The image former 13 includes, as shown in FIG. 1, four writing units 131, an intermediate transfer belt 132, a pair of secondary transfer rollers 133 and a fixing device 134.

The four writing units 131 are arranged in series (tandem) along the belt surface of the intermediate transfer belt 132, and forms C, M, Y and K images, respectively. The writing units 131 are the same in configuration. The difference therebetween is only the color of images to form. Each writing unit 131 includes, as shown in FIG. 2, a light scanner 131*a*, a photoreceptor 131*b*, a developing unit 131*c*, a charger 131*d*, a cleaner 131*e* and a primary transfer roller 131*f*.

At the time of image forming, in each writing unit 131, after the charger 131*d* charges the photoreceptor 131*b*, the optical scanner 131*a* emits a beam on the basis of an original image to scan the photoreceptor 131*b*, thereby forming an electrostatic latent image, and the developing unit 131*c* supplies a color material, such as toner, to develop the electrostatic latent image, thereby forming a toner image on the photoreceptor 131*b*.

The images formed on the photoreceptors 131*b* of the four writing units 131 are successively transferred onto the intermediate transfer belt 132 by their respective primary transfer rollers 131*f* so as to be laid on top of one another (primary transfer), so that an image composed of multiple colors (CMYK image) is formed on the intermediate transfer belt 132. The intermediate transfer belt 132 is an image holder that is wound around a plurality of rollers and rotates. After the primary transfer, the cleaners 131*e* remove the color materials remaining on the respective photoreceptors 131*b*.

In the image former 13, a sheet of paper is fed from a manual feed tray T1 or a paper feed tray T2 to the position of the secondary transfer rollers 133 so as to coincide with the CMYK image on the rotating intermediate transfer belt 132 reaching the position of the secondary transfer rollers 133. One of the secondary transfer rollers 133, which form a pair, contacts the intermediate transfer belt 132 by pressure, and the other is one of the rollers around which the intermediate transfer belt 132 is wound. When the CMYK image on the intermediate transfer belt 132 is transferred onto the sheet by the pressure contact of the secondary transfer roller(s) 133 (secondary transfer), the sheet is conveyed to the fixing device 134 to be subjected to fixation, and then ejected to a paper receiving tray T3. In fixation, a pair of fixing rollers 134*a* heats and presses the sheet, thereby fixing the CMYK image to the sheet. When images are to be formed on both sides of the sheet, the sheet is conveyed to a reversing path 135 so that the sheet is reversed, and the reversed sheet is fed again to the position of the secondary transfer rollers 133.

The storage 14 is a nonvolatile storage including a hard disk drive (HDD) and/or a solid state drive (SSD), and stores various programs, various setting data and so forth so as to be readable and writable from the controller 11.

The operation panel 15 includes the display 151 that displays various types of information for a user(s) and the operation unit 152 that receives operations input by the user.

The display 151 includes a color liquid crystal display, and displays operation screens and so forth (various setting screens, various buttons, operation states of functions, etc.) in accordance with display control signals input from the controller 11.

The operation unit 152 includes a touchscreen arranged on the screen of the display 151 and various hard keys arranged around the screen of the display 151. When a button displayed on the screen is pressed with a finger, a touch pen or the like, the operation unit 152 detects X and Y coordinates of the pressed point by a voltage value, and outputs an operation signal associated with the detected point to the controller 11. The touchscreen is not limited to the pressure-sensitive touchscreen, and may be an electrostatic touchscreen or an optical touchscreen, for example. When a hard key is pressed, the operation unit 152 outputs an operation signal associated with the pressed key to the controller 11. By operating the operation unit 152, the user can, for example, do settings for image forming, such as image quality setting, zoom setting, application setting, output setting and paper setting; make an instruction to convey paper; and stop operation of the image forming apparatus 10.

The communication unit 16 is an interface that connects the image forming apparatus 10 to a communication network N. The communication unit 16 includes an integrated circuit (IC) for communication and a communication connector. Under the control of the controller 10, the communication unit 16 sends/receives various types of information to/from external apparatuses connected to the communication network N, using specific communication protocols. The communication unit 16 can also receive/output various types of information via USB.

Figure 3:
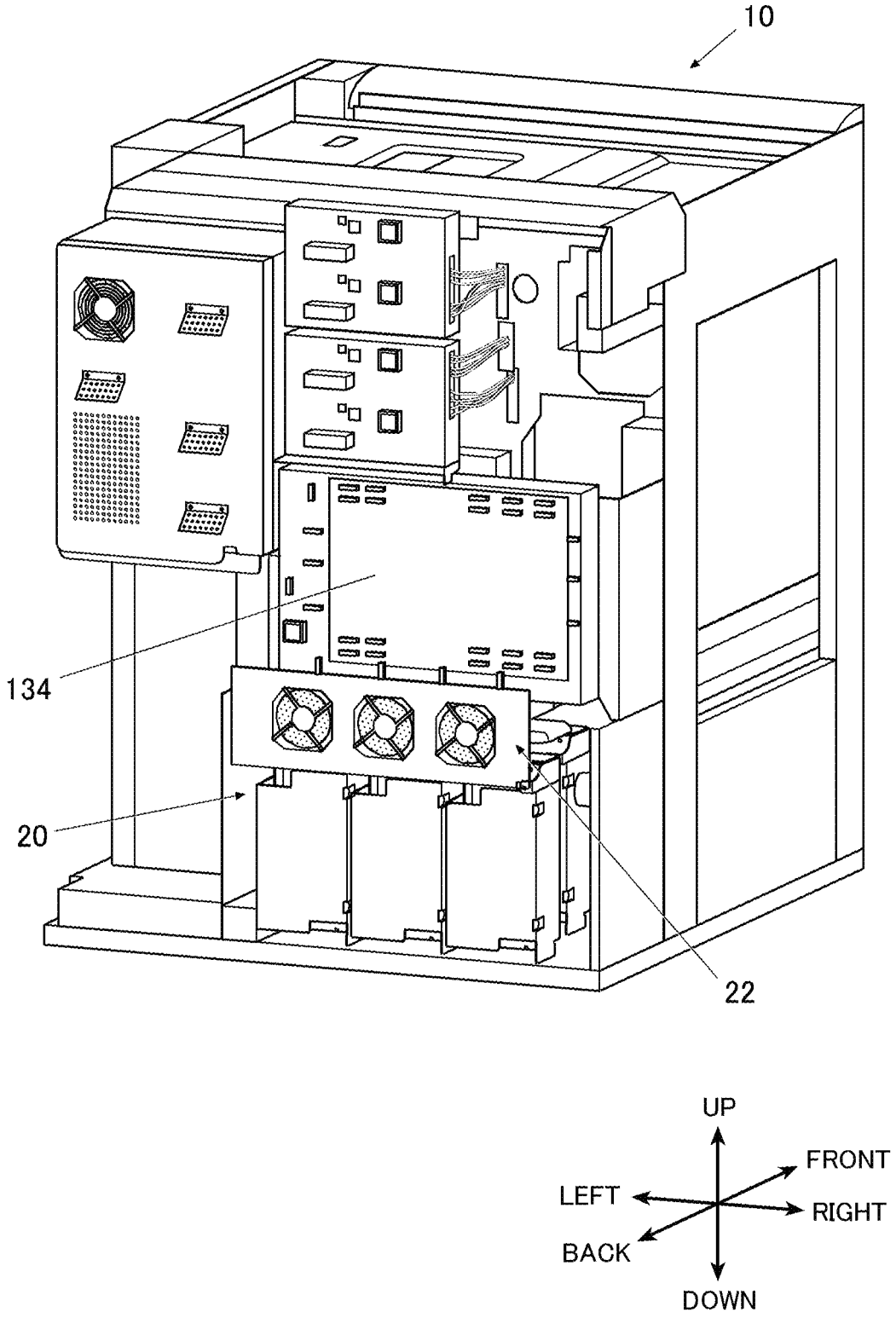
FIG. 3 is a back perspective view schematically showing the configuration of the image forming apparatus.
Figure 4:
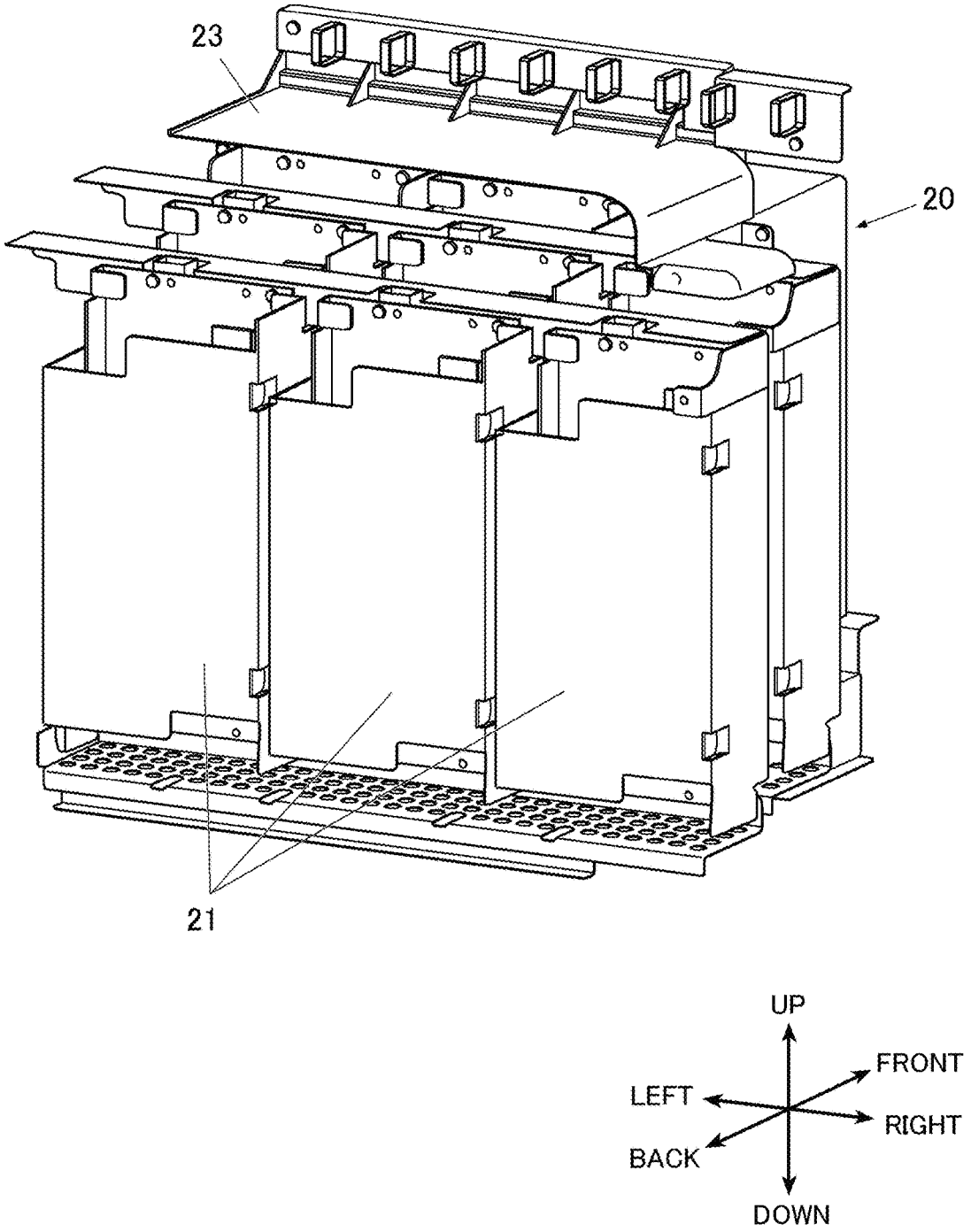
FIG. 4 is a back perspective view showing configuration of a power supply apparatus.

As shown in FIG. 3, the power supply apparatus 20 is arranged under the fixing device 134 at the lower back part of the image forming apparatus 10. The power supply apparatus 20 rectifies and transforms, for example, a power current of AC 200V, thereby forming a control current and/or, for example, a low-voltage current of DC 24V for driving a motor(s) that drives the abovementioned mechanisms, and outputs the current(s) to the mechanisms.

Figure 5:
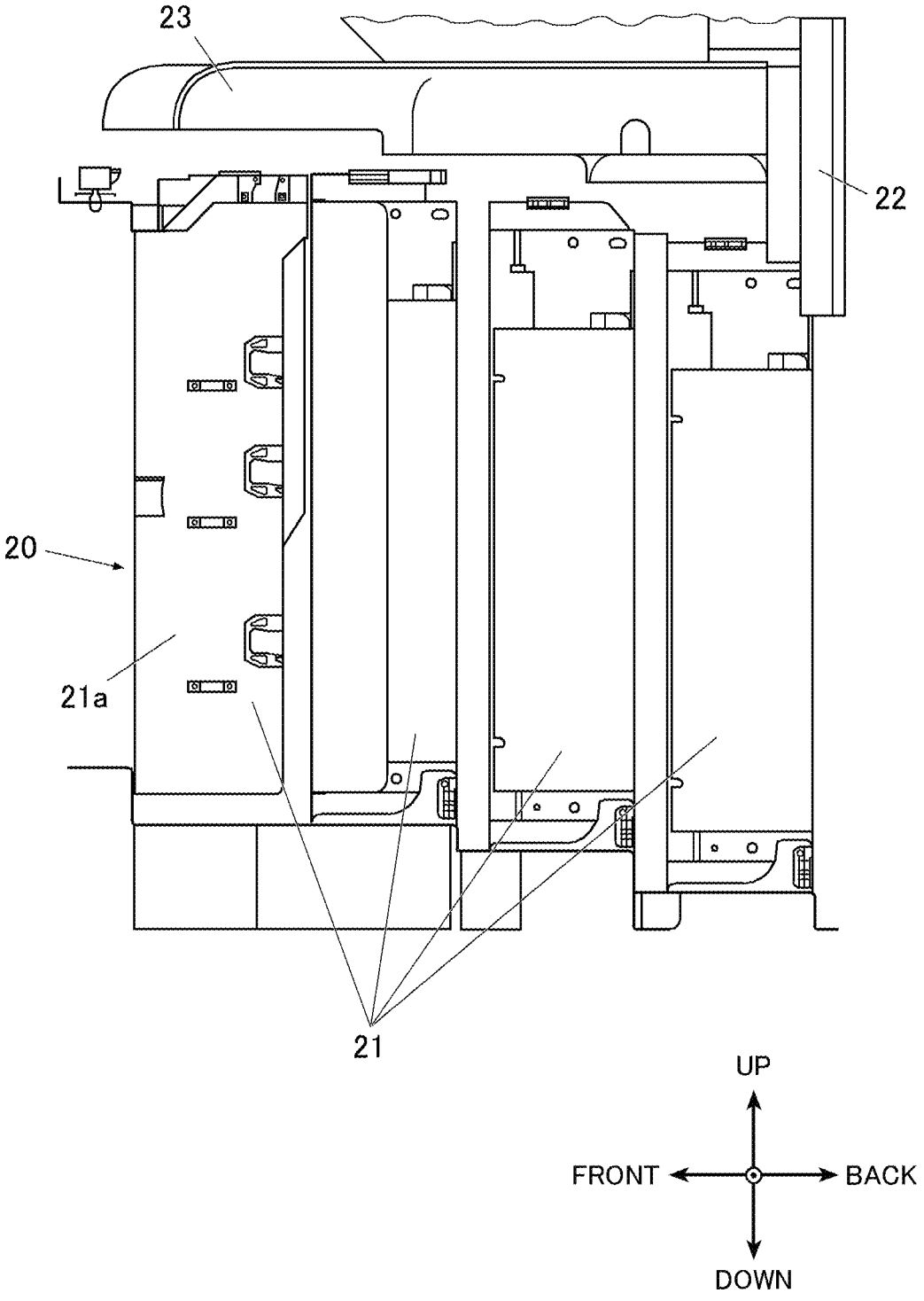
FIG. 5 is a side view showing the configuration of the power supply apparatus.

As shown in FIG. 3 to FIG. 6, the power supply apparatus 20 includes power supply units 21 arranged in three columns in the left-right direction and four rows in the front-back direction. The power supply units 21 are each placed so as to be vertically long, namely, so as to be longer in the up-down direction than in the left-right direction. When the power supply units 21 are each placed so as to be vertically long, air in the power supply apparatus 20 is easy to convect naturally, and consequently exhausted to the outside of the image forming apparatus 10 (outside). In this embodiment, as shown in FIG. 5, these power supply units 21 are arranged in rows in the front-back direction and stepwise (e.g. a rise of about 10 mm) so as to be arranged more upward as arranged more forward (inward) (closer to the front side/inner side).

Like this embodiment, when the power supply units 21 are arranged in three rows (three layers) or more in the front-back direction, it is preferable that the power supply units 21 having a high power supply capacity be arranged on the outer side (back side) of the image forming apparatus 10, and the power supply units 21 having a low power supply capacity be arranged at the center part of the image forming apparatus 10 (at the center (middle) in the power supply units 21 arranged in three rows (three layers) or more in the front-back direction). This is because arranging the power supply units 21 having a low power supply capacity (small amount of heat generation) at the center part, which is surrounded by heat sources and likely to have a high ambient temperature, can increase cooling efficiency.

When the power supply units 21 are arranged in two rows (two layers) in the front-back direction, it is preferable that the power supply units 21 having a high power supply capacity be arranged on the outer side (back side) of the image forming apparatus 10, and the power supply units 21 having a low power supply capacity be arranged on the inner side (front side) of the image forming apparatus 10. This is because arranging the power supply units 21 having a high power supply capacity (large amount of heat generation) on the outer side (back side), where heat is more easily released, can increase cooling efficiency.

Figure 6:
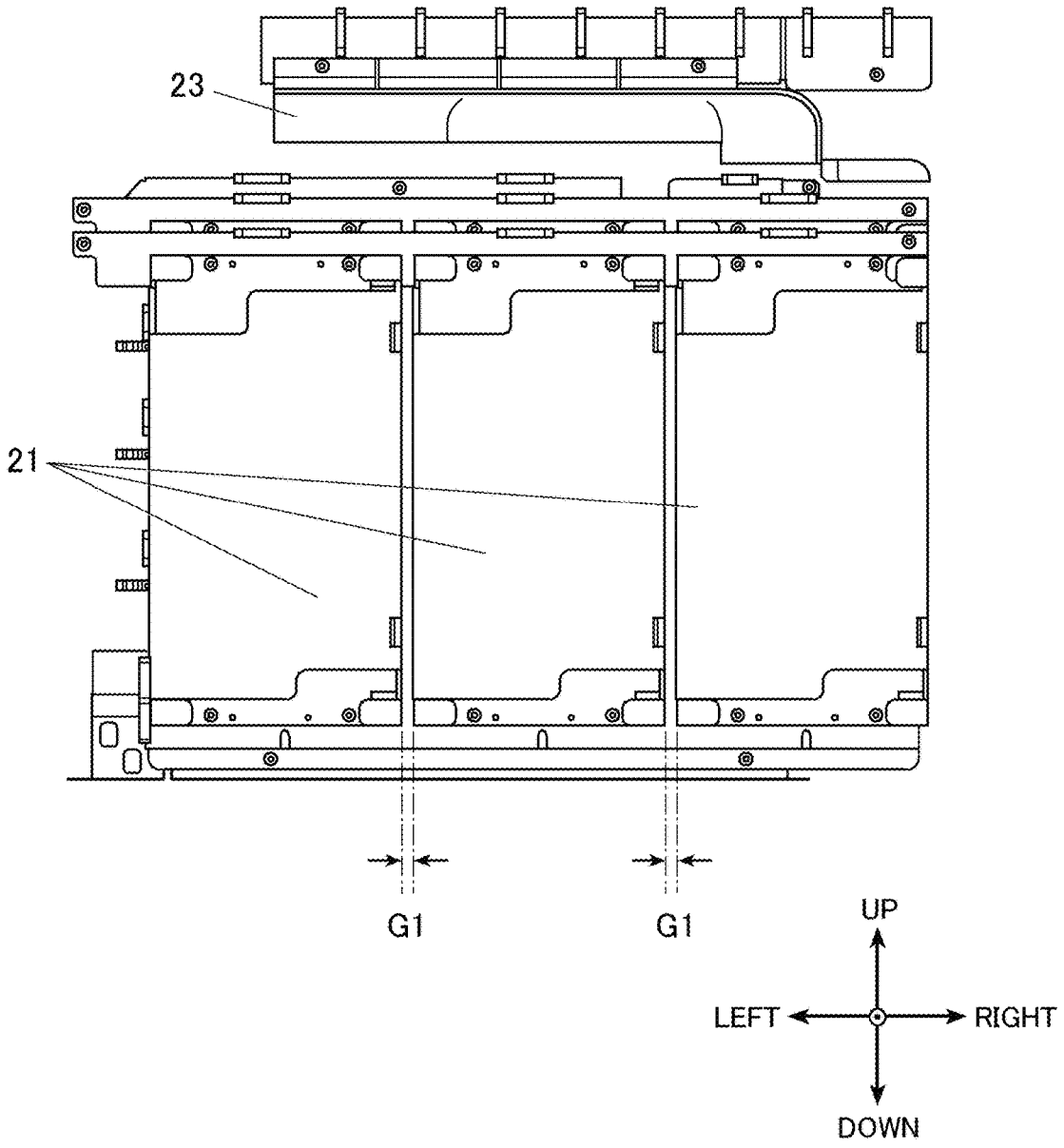
FIG. 6 is a back view showing the configuration of the power supply apparatus.

As shown in FIG. 5, each power supply unit 21 includes a power supply board that supplies power to the components of the image forming apparatus 10 and a heat releasing plate 21*a* (e.g. heatsink) that covers the power supply board from the outside. That is, the power supply board is covered with the heat releasing plate 21*a* from the outside, thereby configuring the power supply unit 21. As shown in FIG. 6 and so forth, the power supply units 21 adjacent to one another in the left-right direction are arranged with a gap G1 (e.g. about 10 mm) in between.

As shown in FIG. 3 and FIG. 5, exhaust fans 22 (cooler) that exhaust the air from the power supply apparatus 20 to the outside of the image forming apparatus 10 (outside) are arranged at the upper part of the power supply apparatus 20 on the back side of the image forming apparatus 10. In this embodiment, three exhaust fans 22 are arranged side by side in the left-right direction. These exhaust fans 22 exhaust (release) the air in the power supply apparatus 20 (heat generated by the power supply boards) to the outside of the image forming apparatus 10 (outside), and consequently can cool the power supply units 21 (power supply boards).

Between the power supply units 21 and the fixing device 134, a blocking wall 23 is arranged. This blocking wall 23 can block heat generated by the fixing device 134 from flowing into the power supply apparatus 20, and consequently can prevent temperature increase of the power supply units 21 (power supply boards). In this embodiment, the blocking wall 23 also functions as a duct of the exhaust fans 22.

Figure 7:
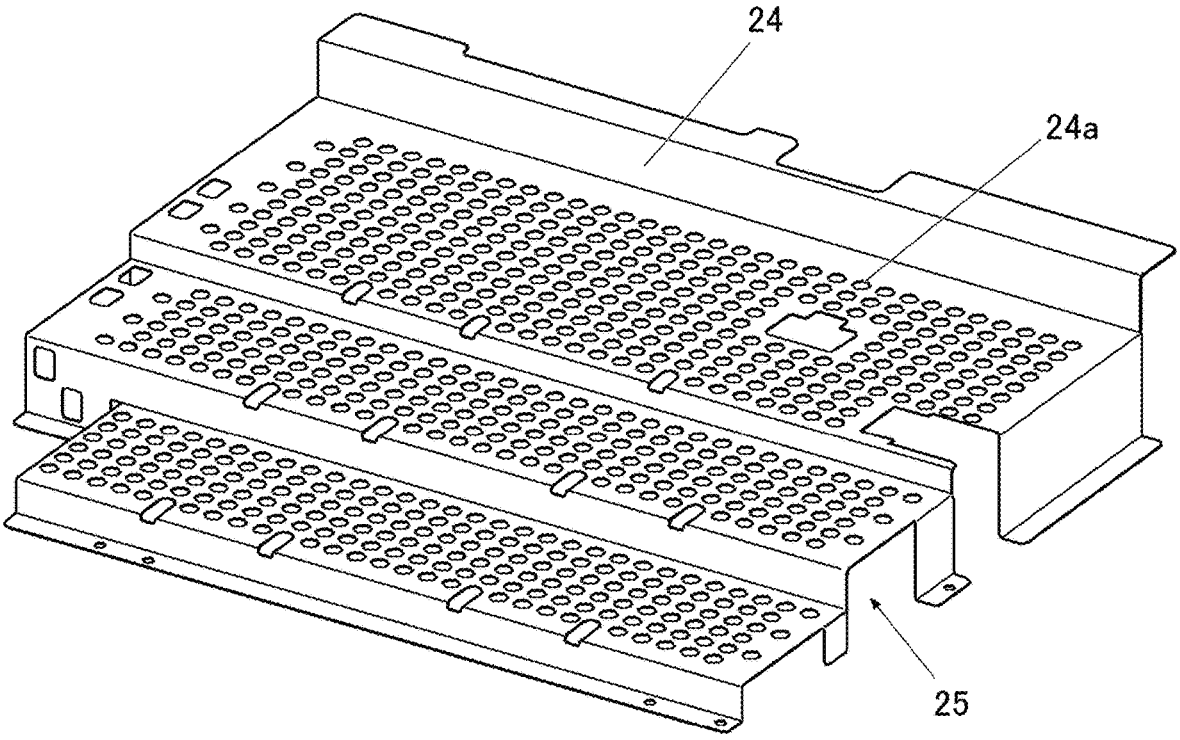
FIG. 7 is a perspective view showing configuration of a sheet metal that supports power supply units from underneath.

On the lower side (bottom) of (under) the power supply units 21, a sheet metal 24 (first sheet metal) that supports the power supply units 21 from underneath is arranged. As shown in FIG. 7, the sheet metal 24 is configured to be stepwise (stepwise configuration) such that a more forward (inward) part is a more upward part.

Of the sheet metal 24, parts that support the power supply units 21 (parts under the power supply units 21) are provided with a plurality of holes 24*a*. This configuration can take air blown up from under the sheet metal 24 into the power supply units 21, and consequently can cool the power supply units 21 (power supply boards).

Further, under the sheet metal 24, a wire bundle path 25 that can house various cords (where various cords can be arranged) is arranged.

Figure 8:
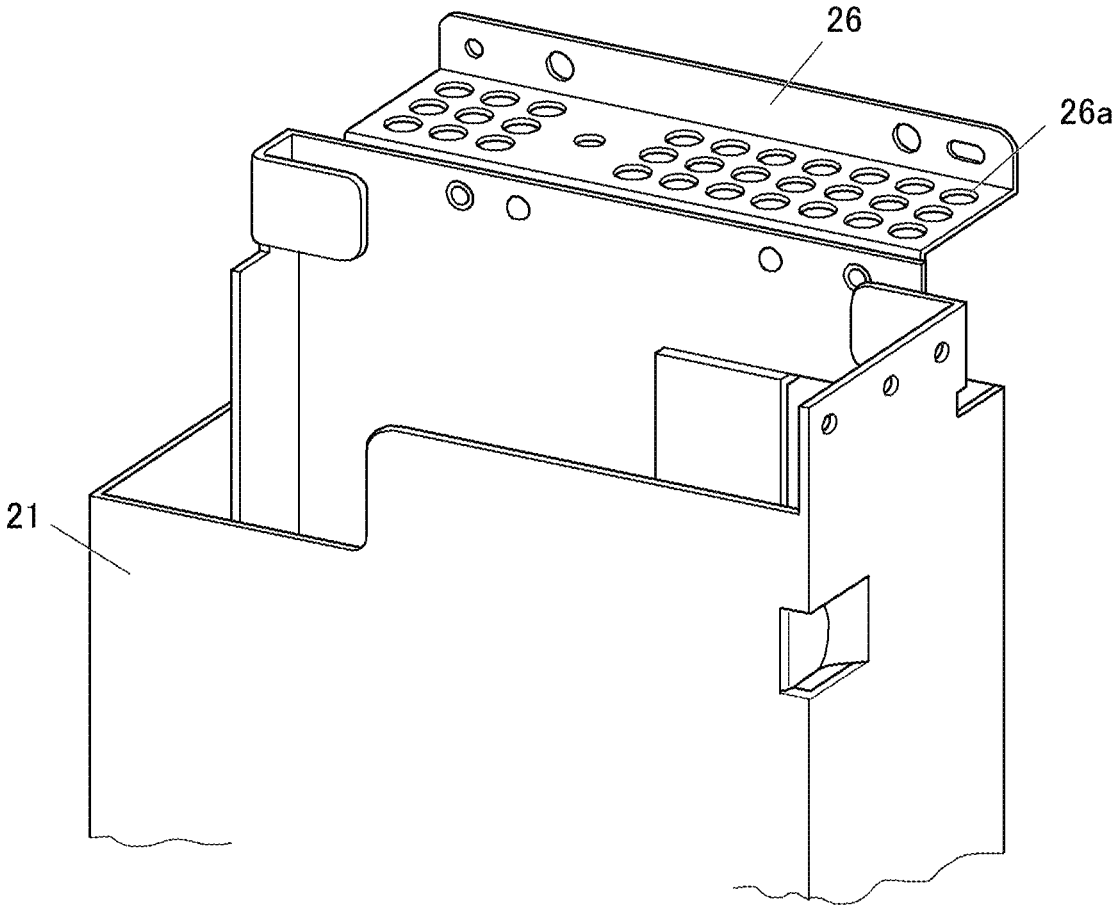
FIG. 8 is a perspective view showing configuration of a sheet metal that supports the power supply unit(s) from above.

As shown in FIG. 8, over the power supply unit(s) 21, a sheet metal(s) 26 (second sheet metal) that supports the power supply units 21 from above is arranged. The sheet metal 26 is provided with a plurality of holes 26*a*. This configuration can flow the air blown up from under the sheet metal 24 to above the sheet metal 26, and consequently can release the heat generated by the power supply units 21 (power supply boards).

As described above, the power supply apparatus 20 of the image forming apparatus 10 according to this embodiment includes: the power supply boards that supply power; and the cooler (exhaust fans 22) that cools the power supply boards, wherein the power supply boards are disposed in rows in the front-back direction and stepwise so as to be disposed more upward as disposed more forward.

Hence, the power supply apparatus 20 of this embodiment can efficiently release, with the cooler, the heat generated by the power supply boards, and consequently can prevent increase in internal temperature, thereby preventing malfunctions and damage to the power supply boards.

Further, in the power supply apparatus 20 according to this embodiment, the cooler includes the exhaust fan(s) 22 that releases the heat generated by the power supply boards to the outside.

Hence, the power supply apparatus 20 of this embodiment can exhaust (release), with the exhaust fan 22, the air in the power supply apparatus 20 (heat generated by the power supply boards) to the outside of the image forming apparatus 10 (outside), and consequently can cool the power supply boards.

Further, in the power supply apparatus 20 according to this embodiment, as the exhaust fan 22, two or more exhaust fans 22 are disposed.

Hence, the power supply apparatus 20 of this embodiment can exhaust (release), with the exhaust fans 22, the air in the power supply apparatus 20 (heat generated by the power supply boards) to the outside of the image forming apparatus 10 (outside), and consequently can cool the power supply boards.

Further, in the power supply apparatus 20 according to this embodiment, the power supply boards are covered with the heat releasing plates 21*a* from outside thereof, thereby configuring the power supply units 21, and the power supply units 21 are disposed in rows in the front-back direction and stepwise.

Hence, the power supply apparatus 20 of this embodiment can efficiently release, with the cooler, the heat generated by the power supply boards, and consequently can prevent increase in internal temperature, thereby preventing malfunctions and damage to the power supply boards. Further, the power supply apparatus 20 of this embodiment can accelerate, with the heat releasing plates 21*a*, heat release of the power supply boards, and consequently can increase cooling efficiency.

Further, in the power supply apparatus 20 according to this embodiment, when the power supply boards are disposed in two rows in the front-back direction, the power supply boards having a high power supply capacity are disposed on the back side and having a low power supply capacity are disposed on the front side.

Thus, the power supply apparatus 20 of this embodiment has the power supply units 21 having a high power supply capacity (large amount of heat generation) on the outer side (back side), where heat is more easily released, and hence can increase cooling efficiency.

Further, in the power supply apparatus 20 according to this embodiment, when the power supply boards are disposed in three rows or more in the front-back direction, the power supply boards having a high power supply capacity are disposed on the back side and having a low power supply capacity are disposed at the center part.

Thus, the power supply apparatus 20 of this embodiment has the power supply units 21 having a low power supply capacity (small amount of heat generation) at the center part, which is surrounded by heat sources and likely to have a high ambient temperature, and consequently can increase cooling efficiency.

Further, in the power supply apparatus 20 according to this embodiment, the power supply boards adjacent to one another in a direction that is orthogonal to the front-back direction and the up-down direction are disposed with the gap G1 in between.

Hence, the power supply apparatus 20 of this embodiment can accelerate heat release of the power supply boards, and consequently can increase cooling efficiency.

Further, the power supply apparatus 20 according to this embodiment further includes the blocking wall 23 between the power supply boards and the fixing device 134.

Hence, the power supply apparatus 20 of this embodiment can block the heat generated by the fixing device 134 from flowing into the power supply apparatus 20, and consequently can prevent temperature increase of the power supply boards.

Further, in the power supply apparatus 20 according to this embodiment, the blocking wall 23 has a function as a duct of the cooler.

Hence, the power supply apparatus 20 of this embodiment can accelerate exhaustion (release) of the air in the power supply apparatus 20 (heat generated by the power supply boards) to the outside, and consequently can increase cooling efficiency.

Further, the power supply apparatus 20 according to this embodiment further includes the first sheet metal (sheet metal 24) under the power supply boards, the first sheet metal supporting the power supply boards from underneath, wherein the first sheet metal is configured to be stepwise such that a more forward part is a more upward part.

Hence, the power supply apparatus 20 of this embodiment can arrange the power supply boards in the front-back direction and stepwise, and consequently can efficiently release the heat generated by the power supply boards, and prevent increase in internal temperature, thereby preventing malfunctions and damage to the power supply boards.

Further, in the power supply apparatus 20 according to this embodiment, the first sheet metal is provided with the holes 24*a*.

Hence, the power supply apparatus 20 of this embodiment can take the air blown up from under the first sheet metal into the power supply boards, and consequently can cool the power supply boards.

Further, the power supply apparatus 20 according to this embodiment further includes the wire bundle path 25 under the first sheet metal.

Hence, the power supply apparatus 20 of this embodiment can collectively house various cords used for wiring, and consequently can prevent people from stumbling over the cords and prevent the various cords from being broken.

Further, the power supply apparatus 20 according to this embodiment further includes the second sheet metal (sheet metal(s) 26) over the power supply boards, the second sheet metal supporting the power supply boards from above.

Hence, the power supply apparatus 20 of this embodiment can stably fix the power supply boards, and consequently can efficiently release the heat generated by the power supply boards.

Further, in the power supply apparatus 20 according to this embodiment, the second sheet metal is provided with the holes 26*a*.

Hence, the power supply apparatus 20 of this embodiment can flow the air blown up from under the first sheet metal to above the second sheet metal, and consequently can release the heat generated by the power supply boards.

Although one or more embodiments of the present invention have been described in detail, they are not intended to limit the present invention, and modifications can be made without departing from the scope of the present invention.

For example, in the above embodiment, the power supply units 21 are each disposed so as to be vertically long, but not limited thereto. For example, the power supply units 21 may be each disposed so as to be horizontally long, namely so as to be longer in the left-right direction than in the up-down direction.

Further, in the above embodiment, the power supply boards arranged are in the form of the power supply units 21, but not limited thereto. For example, the power supply boards uncovered with the heat releasing plates 21*a* may be arranged.

Further, in the above embodiment, the exhaust fans 22 are cited as the cooler, but the cooler is not limited thereto. For example, an air-blowing fan(s) that sends air to and thereby cools the power supply units 21 (power supply boards) may be used.

Further, when the power supply units 21 are arranged in the front-back direction and stepwise, the rises may be uniform, or the rise provided for the power supply units 21 arranged more forward (inward) may be larger. The rise provided for the power supply units 21 arranged more forward (inward) being larger can efficiently release, with the cooler, the heat generated by the power supply boards, and consequently can increase cooling efficiency.

The detailed configuration and detailed operation of each component of the image forming apparatus can be appropriately modified without departing from the scope of the present invention.

Although one or more embodiments of the present invention have been described and illustrated in detail, the disclosed embodiments are made for purposes of not limitation but illustration and example only. The scope of the present invention should be interpreted by terms of the appended claims.

What is claimed is:

1. A power supply apparatus comprising:

a plurality of power supply boards that supplies power;

a cooler that cools the power supply boards; and a first sheet member under the power supply boards, the first sheet member supporting the power supply boards from underneath, wherein the power supply boards are disposed in rows in a predetermined direction, and adjacent power supply boards of the power supply boards are disposed stepwise so as to be disposed more upward as disposed more inward, and wherein the first sheet member is configured to be stepwise such that a more inward part is a more upward part.

2. The power supply apparatus according to claim 1, wherein the cooler includes an exhaust fan that releases heat generated by the power supply boards to outside.

3. The power supply apparatus according to claim 2, wherein the exhaust fan includes a plurality of exhaust fans.

4. The power supply apparatus according to claim 1, wherein the power supply boards are covered with heat releasing plates from outside thereof, thereby configuring power supply units, and wherein the power supply units are disposed in the rows in the predetermined direction and stepwise.

5. The power supply apparatus according to claim 1, wherein when the power supply boards are disposed in two rows in the predetermined direction, the power supply boards having a high power supply capacity are disposed on an outward side and having a low power supply capacity are disposed on an inward side.

6. The power supply apparatus according to claim 1, wherein when the power supply boards are disposed in three rows or more in the predetermined direction, the power supply boards having a high power supply capacity are disposed on an outward side and having a low power supply capacity are disposed at a center part.

7. The power supply apparatus according to claim 1, wherein the power supply boards adjacent to one another in a direction that is orthogonal to the predetermined direction and an up-down direction are disposed with a gap in between.

8. The power supply apparatus according to claim 1, wherein the power supply boards are each disposed so as to be vertically long or horizontally long.

9. The power supply apparatus according to claim 1, further comprising a blocking wall between the power supply boards and a fixing device.

10. The power supply apparatus according to claim 9, wherein the blocking wall has a function as a duct of the cooler.

11. The power supply apparatus according to claim 1, wherein the first sheet member is provided with a plurality of holes.

12. The power supply apparatus according to claim 1, further comprising a wire bundle path under the first sheet member.

13. The power supply apparatus according to claim 1, further comprising a second sheet member over the power supply boards, the second sheet member supporting the power supply boards from above.

14. The power supply apparatus according to claim 13, wherein the second sheet member is provided with a plurality of holes.

15. An image forming apparatus comprising:

an image former that forms an image on paper; and the power supply apparatus according to claim 1, wherein the power supply apparatus supplies power to the image former.

16. A power supply apparatus comprising:

a plurality of power supply boards that supplies power; and a cooler that cools the power supply boards, wherein the power supply boards are disposed in rows in a predetermined direction and stepwise so as to be disposed more upward as disposed more inward, and wherein when the power supply boards are disposed in two rows in the predetermined direction, the power supply boards having a high power supply capacity are disposed on an outward side and having a low power supply capacity are disposed on an inward side.

17. A power supply apparatus comprising:

a plurality of power supply boards that supplies power; and a cooler that cools the power supply boards, wherein the power supply boards are disposed in rows in a predetermined direction and stepwise so as to be disposed more upward as disposed more inward, and the power supply apparatus further comprises a first sheet metal under the power supply boards, the first sheet metal supporting the power supply boards from underneath, wherein the first sheet metal is configured to be stepwise such that a more inward part is a more upward part.

* * * * *